US007716874B2

(12) United States Patent
Ventrola

(10) Patent No.: US 7,716,874 B2
(45) Date of Patent: May 18, 2010

(54) EXPANDABLE GATE

(75) Inventor: Todd Ventrola, Liberty Township, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 300 days.

(21) Appl. No.: 10/946,038

(22) Filed: Sep. 21, 2004

(65) Prior Publication Data

US 2006/0059779 A1 Mar. 23, 2006

(51) Int. Cl.
*E06B 9/02* (2006.01)

(52) U.S. Cl. ..... 49/55; 49/57; 49/50; 49/463; 49/465

(58) Field of Classification Search ..... 49/50, 49/55, 57, 463, 465; 292/137, 159, 175, 292/150, 145, 152, 302, 303, DIG. 29, DIG. 38, 292/DIG. 46

See application file for complete search history.

(56) References Cited

U.S. PATENT DOCUMENTS 4,149,342 A * 4/1979 Bowers ..... 49/55
4,492,263 A 1/1985 Gebhard
4,607,455 A 8/1986 Bluem et al.
4,611,431 A 9/1986 Lauro
4,677,791 A 7/1987 Larson et al.
4,702,036 A 10/1987 Johnson
4,777,765 A 10/1988 Johnson, Jr.
4,831,777 A 5/1989 Johnson, Jr.
4,846,246 A * 7/1989 Stern ..... 160/224
4,884,614 A 12/1989 Spurling
4,944,117 A * 7/1990 Gebhard et al. ..... 49/55
5,367,829 A 11/1994 Crossley et al.
5,437,115 A 8/1995 Freese et al.
5,528,859 A 6/1996 Taylor et al.
5,782,039 A * 7/1998 Scherer et al. ..... 49/465
5,829,505 A 11/1998 Brescia
5,906,068 A 5/1999 Bode
5,906,069 A 5/1999 Berliner
5,924,242 A 7/1999 Macari et al.
6,449,901 B1 9/2002 Gibree et al.

* cited by examiner

*Primary Examiner*—Gregory J. Strimbu
(74) *Attorney, Agent, or Firm*—Taft Stettinius & Hollister LLP

(57) ABSTRACT

A variable width gate for adaptively mating with boundaries of an opening to provide a barrier therebetween, the variable width gate comprising: (a) an extendable gate including a first gate section mounted to a second gate section, wherein either the first gate section or the second gate section includes a rib; (b) a tracker adapted to engage the rib and operatively coupled to the other of the first gate section or the second gate section not having the rib; and (c) a handle operatively coupled to one of the tracker and the rib, such that displacement of the handle manipulates the position of the tracker in relation to the rib to horizontally reposition the first gate section with respect to the second gate section.

21 Claims, 7 Drawing Sheets

EXPANDABLE GATE

BACKGROUND

1. Field of the Invention

The present invention is directed to an impediment to inhibit movement through an opening, and more specifically to an expandable gate adapted to occupy at least a portion of an opening to inhibit travel therethrough. The expandable feature of the gate provides the functionality of custom fitting to occupy at least a portion of the opening and thereafter to retract and/or pivot to no longer occupy the same portion of the opening, thereby allowing free movement through the unoccupied portion.

2. Background of the Invention

A variety of gates are known and presently on the market that are designed to prevent children from passing from one area into another or from ascending or descending stairways. Several of these gates can be adjusted for use in openings having various widths.

Presently there are two common types of adjustable, pressure mounted, security gates that are used in the home for children and pets that include a plurality of gate panels that are roughly adjusted to inhibit movement through a passageway. The first type includes extendible bumpers on at least one side thereof that firmly engage the boundary defining of the passageway to hold the gate in place. The second type includes fixed position bumpers mounted to the gate panels that are caused to firmly engage the boundary defining the passageway by extending the gate panels.

Gates having extendable bumpers may incorporate mechanisms that include numerous interconnecting parts that require precise fits and positioning to interact with each other to extend and retract the bumpers. Gates are also known that utilize actuating mechanisms that include a complex arrangement of links, cranks, pull rods and springs that are interconnected to a pull handle. An example of such an actuating mechanism is disclosed in U.S. Pat. No. 5,052,461.

SUMMARY OF THE INVENTION

The present invention is directed to an impediment to inhibit movement through an opening, and more specifically to an expandable gate adapted to occupy at least a portion of the opening to inhibit travel therethrough. The expandable gate includes the functionality of custom fitting to occupy at least a portion of the opening and thereafter to retract and/or pivot to no longer occupy the portion of the opening, thereby allowing movement through the opening.

In an exemplary embodiment, the present invention comprises an expandable gate having a memory mechanism that provides for an incremental increase of the widthwise dimension of the gate to position the gate between boundary points of an opening and provide for an incremental decrease in the widthwise dimension of the gate to remove the gate from the opening without fully retracting the gate to conform to its minimum widthwise dimension. The invention allows for easy removal of the gate from the opening and retaining a memory of the width of the opening such that an incremental increase in the widthwise dimension of the gate will once again create the necessary width to secure the gate within the opening. Various methods of accomplishing such an incremental increase/decrease in the widthwise dimension as well as facilitating this change by manipulation of a handle are also disclosed herein.

It is a first aspect of the present invention to provide a variable width gate for adaptively mating with boundaries of an opening to provide a barrier therebetween, the variable width gate comprising: (a) an extendable gate including a first gate section mounted to a second gate section, wherein at least one of the first gate section and the second gate section includes a rib; (b) a tracker adapted to engage the rib and operatively coupled to at least one of the first gate section and the second gate section; and, (c) a lock mounted to the first gate section to secure the first gate section in relation to the second gate section, the lock comprising a handle operatively coupled to at least one of the tracker and the rib, such that displacement of the handle manipulates the position of the tracker in relation to the rib to reposition the first gate section with respect to the second gate section.

DETAILED DESCRIPTION

Figure 1:
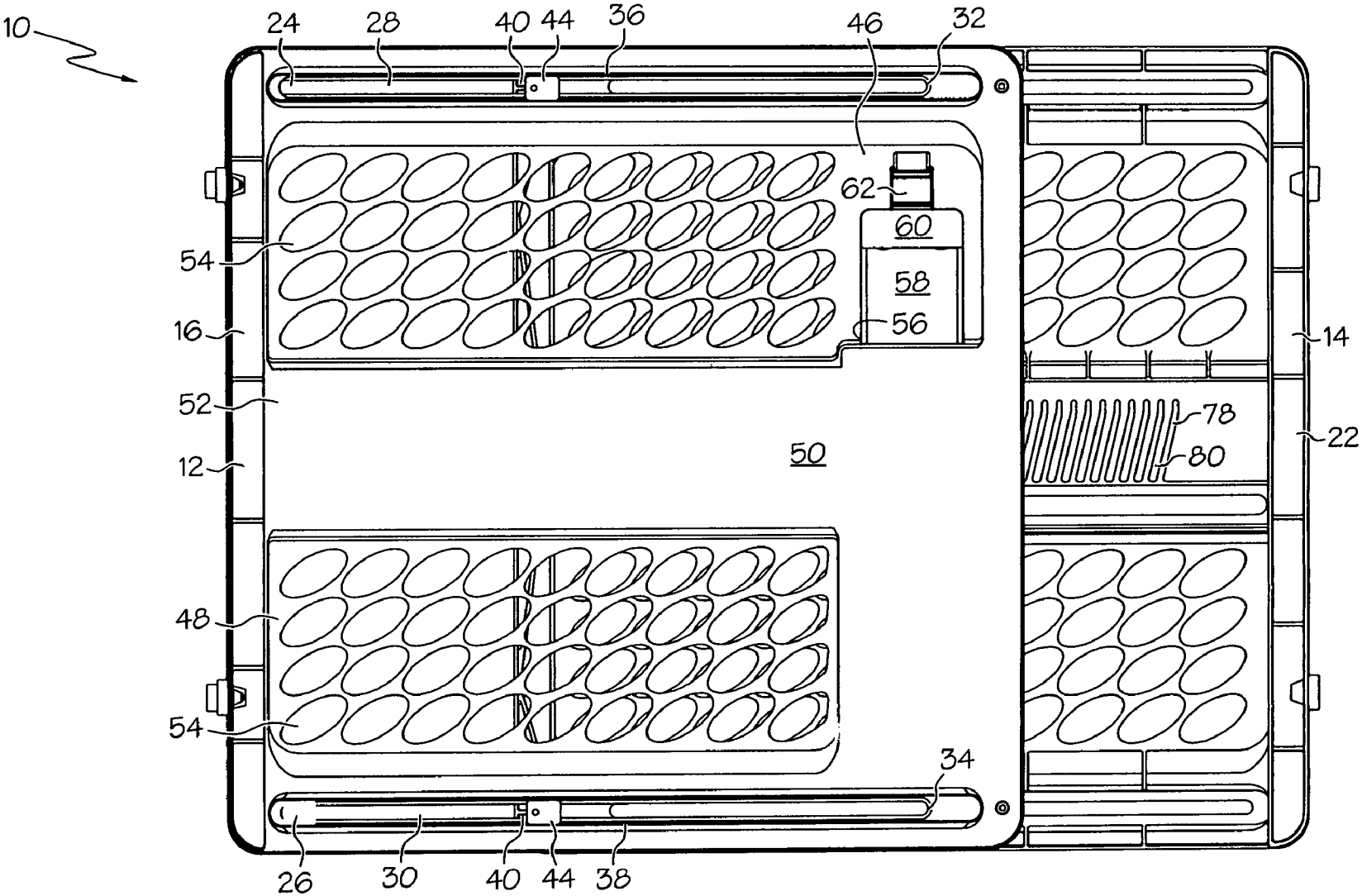
FIG. 1 is a frontal view of a first exemplary embodiment in accordance with the present invention.
Figure 2:
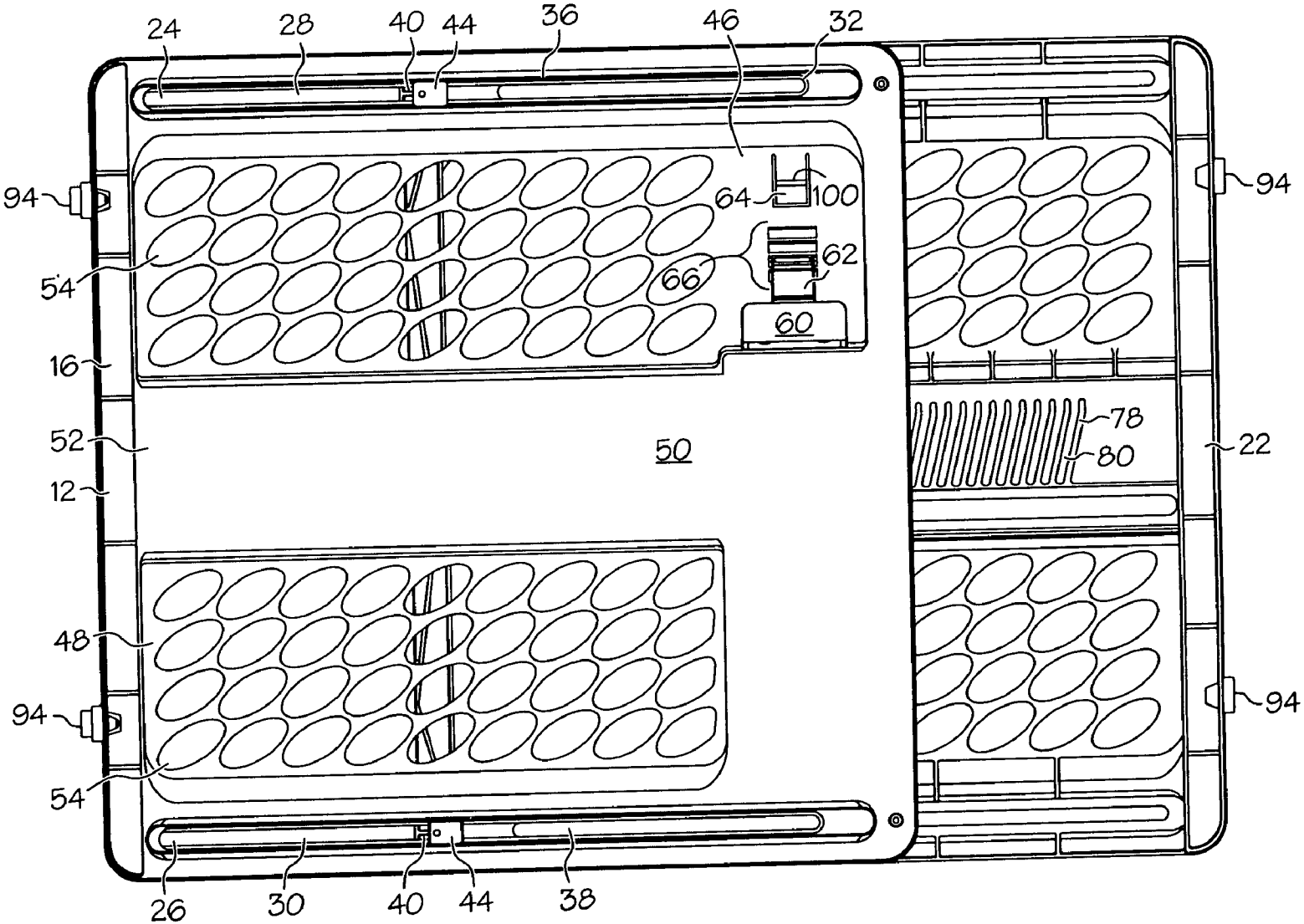
FIG. 2 is a frontal view of the first exemplary embodiment of FIG. 1 inhibiting widthwise variation.

The exemplary embodiments of the present invention are described and illustrated below as expandable gates or gate sections operative to occupy at least a portion of an opening to inhibit movement therethrough. For clarity and precision, only a single orientational or positional reference will be utilized. Therefore, the various orientational, positional, and reference terms used to describe the elements of the exemplary embodiments of the present invention are only used to describe the elements in relation to one another and may be reconfigured by one of ordinary skill in the art without departing from the scope and spirit of the present invention.

Referring to FIGS. 1-6, a first exemplary embodiment 10 includes a first gate section 12 mounted to a second gate section 14. Each gate section 12, 14 includes a front side 16 and rear side 22, where the rear side of the first gate section 12 faces the rear side 22 of the second gate section 14 and the front side 16 of the first gate section 12 faces opposite the front side of the second gate section 14.

The front side 16 of the first gate section 12 includes a top channel 24 and a bottom channel 26, each having an opening 28, 30 therethrough. Each opening 28, 30 is circumferentially bound by a raised wall 32, 34 having a top circumferential surface 36, 38 that acts as a slide and is adapted to contact a guide 40. Each guide 40 includes a post 42 mounted to the rear side 22 of the second gate section 14 that protrudes through one of the openings 28, 30 to which a plate 44 is mounted thereto to facilitate sliding of the plate 44 over one of the top circumferential surface 36, 38. In this exemplary embodiment, a screw is utilized as a fastener to mount the plate 44 to the post 42. In this manner, the total width of the gate 10 may be varied by repositioning the first gate section 12 with respect to the second gate section 14.

The front side 16 of the first gate section 12 also includes two recessed areas 46, 48 at least partially bounded by an L-shaped raised area 50. A middle channel 52 separates the two recessed areas 46, 48 that each include a series of orifices 54 therethrough to facilitate visual identification across the gate section 12 when in use. The front side 16 of the first gate section 12 also includes an opening 56 therein adapted to accommodate movement of a handle 58 therethrough. The handle 58 includes a detachable cup 60 and a repositionable tab 62 that is adapted to interface with a biased detent 64 and a series of rectangular holes 66 to secure the position of the handle 58 with respect to the first gate section 12.

Figure 3:
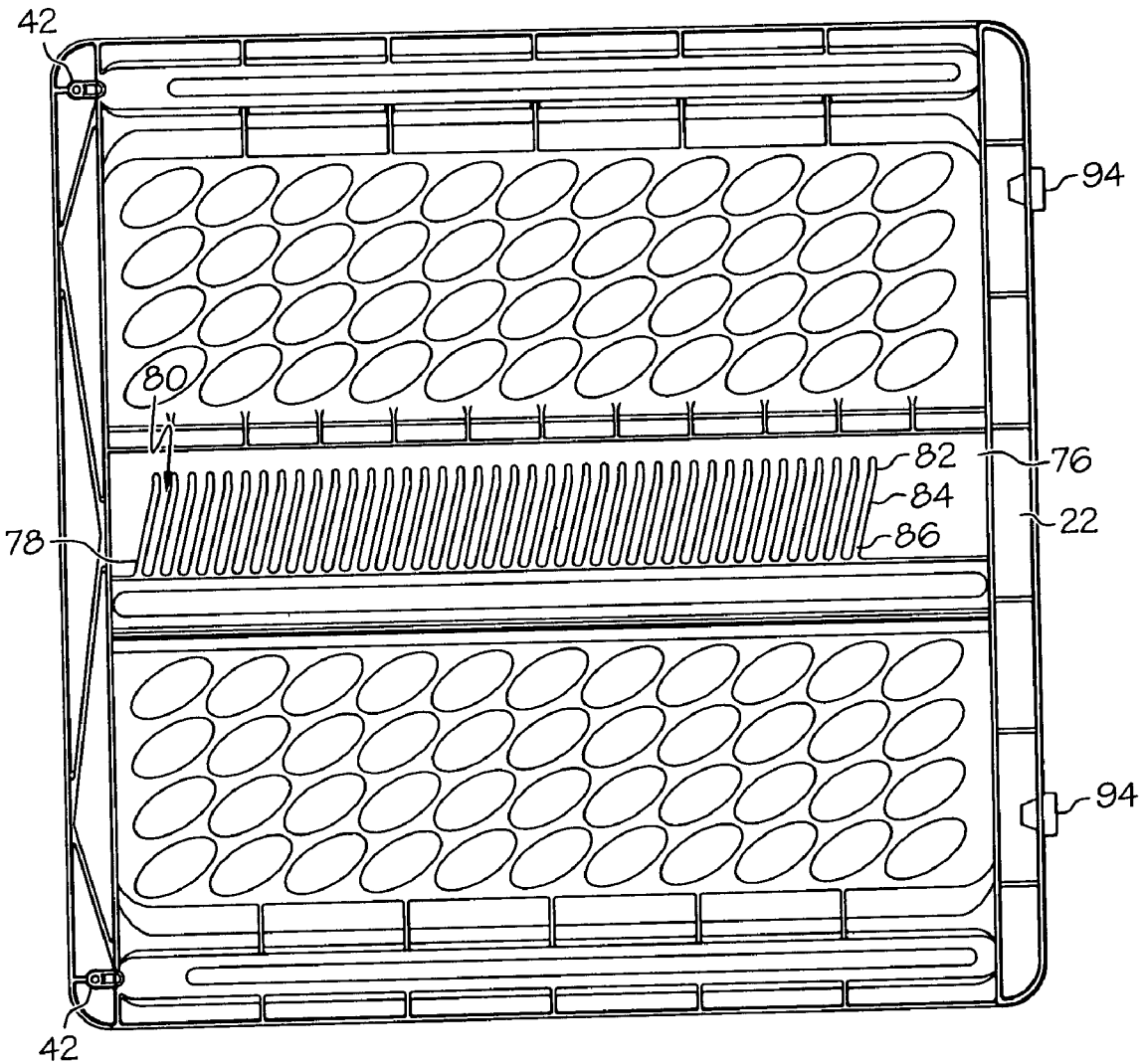
FIG. 3 is a roar view of a first exemplary gate section in accordance with the present invention.
Figure 4:
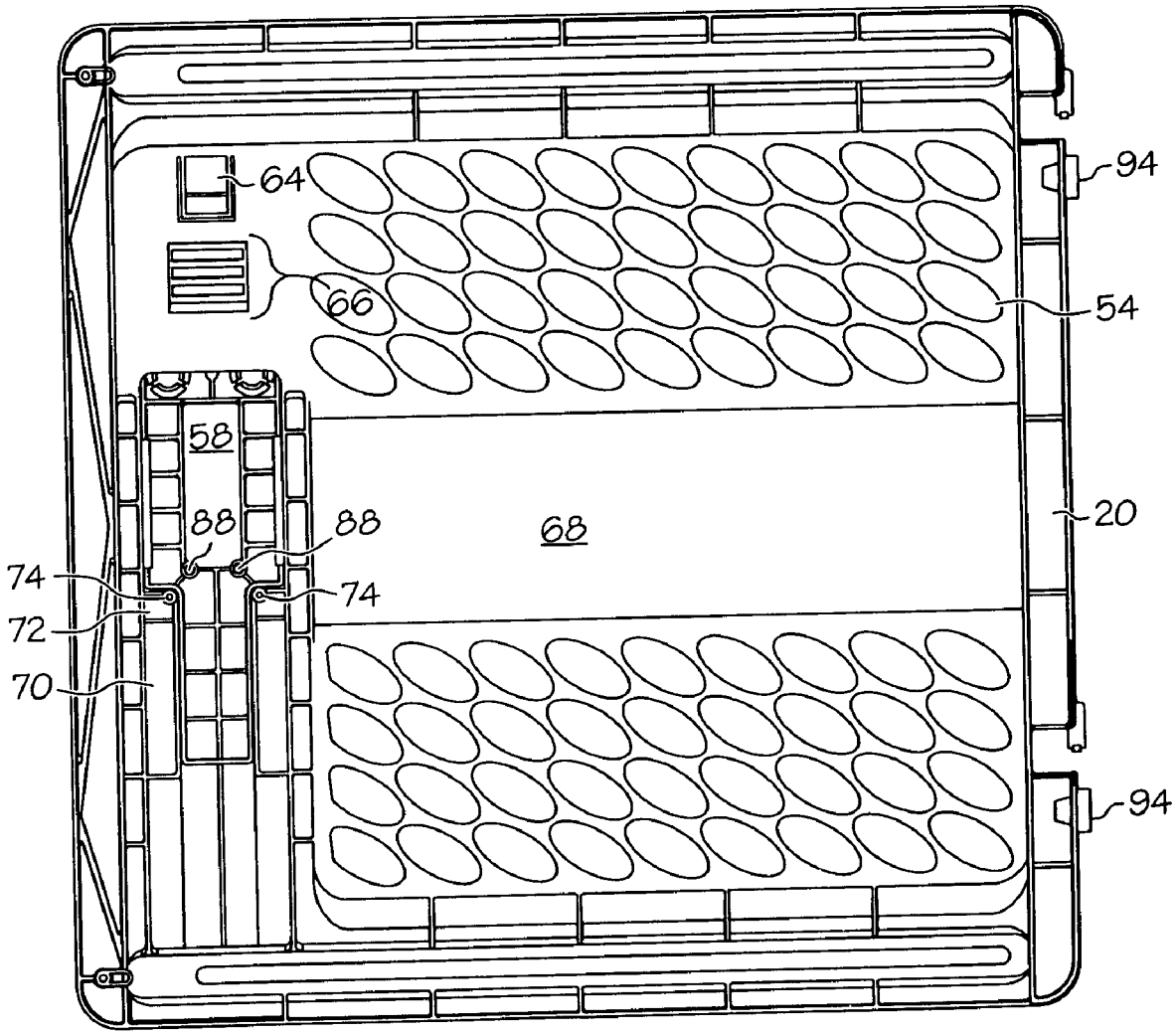
FIG. 4 is a rear view of a second exemplary gate section in accordance with the present invention.

Referring to FIGS. 3 and 4, the rear side 20 of the first gate section 12 includes a recessed area 68 corresponding to the L-shaped raised area 50 on the front side 16. The recessed area includes a T-shaped track 70 to guide movement of the handle 58. The tapered portion 72 of the track 70 includes two alignment pins 74 that inhibit movement of the upper aspect of the handle 58 beyond the pins 74.

The rear side 22 of the second gate section 14 includes a recessed area 76 having a plurality of staggered ribs 78 with corresponding grooves 80 therebetween. Each rib 78 includes a top segment 82 essentially vertically oriented that transitions into an angled segment 84 occupying a majority of the length of the rib 78 that transitions into a bottom segment 86. The grooves 80 between the ribs 78 are adapted to receive one or more projections 88 from the handle 58 to orient the first gate section 12 with respect to the second gate section 14.

Each gate section 12, 14 includes a stopper 90, 92 mounted thereto to inhibit movement of the gate sections 12, 14 beyond a predetermined point. A pair of resilient bumpers 94 are mounted to the ends of the gate sections 12, 14 to conform to minor imperfections in a boundary of an opening where the sections are adapted to be wedged.

Referring to FIGS. 1-7, to configure the first exemplary embodiment 10 within an opening, for example a doorframe, the first gate section 12 is moved with respect to the second gate section 14 such that the distance between the stoppers 90, 92 is increased to position the bumpers 94 approximate the boundary of the opening. The handle 58 during this manipulation of the gate sections 12, 14 is in the upright position where a catch 98 associated with the tab 62 is seated within a recess 100 of the detent 64. In this position, the projections 88 of the handle are not within one or more grooves 80 between the ribs 78. After the gate sections 12, 14 have been repositioned approximate the boundary of the opening, evidenced by the bumpers 94 touching or nearly touching the boundary, the handle 58 is repositioned such that the projections 88 are aligned within at least two respective grooves 80; i.e., the projections 88 are between adjacent ribs 78 approximate the top segment 82 (see FIG. 6). This position inhibits the sections 12, 14 from being repositioned with respect to one another beyond an incremental measure dictated by the contour of the ribs 78 and resulting grooves 80 therebetween. The projections 88 riding upon the ribs 78 are effective to transform the movement of the handle 58 into movement of the sections 12, 14. In sum, the contour/orientation of the ribs 78 is determinative of how movement of the handle 58 will be transformed into movement of the sections 12, 14. In this exemplary embodiment, vertical movement of the handle 58 is transformed into horizontal expansion of the gate 10.

For example, a rib oriented at a 45 degree angle would essentially accommodate vertical movement of the handle and result in a 1:1 correspondence where one inch of movement of the handle would result in a one inch change in width of the gate 10. By varying the angle other than 45 degrees, the transformation can be modified. For instance, where the goal was to maximize changes in width of the gate using minimal handle movement, an angle approximating 0 degrees would be chosen. In contrast, where the goal was to minimize changes in width of the gate using maximum handle movement, an angle approximating 90 degrees would be chosen. In this exemplary embodiment, the angle has been chosen to be greater than 45 degrees, however, such an angle choice is within the purview of one of ordinary skill and all such angles between 0-90 fall within the scope of the present invention.

Figure 5:
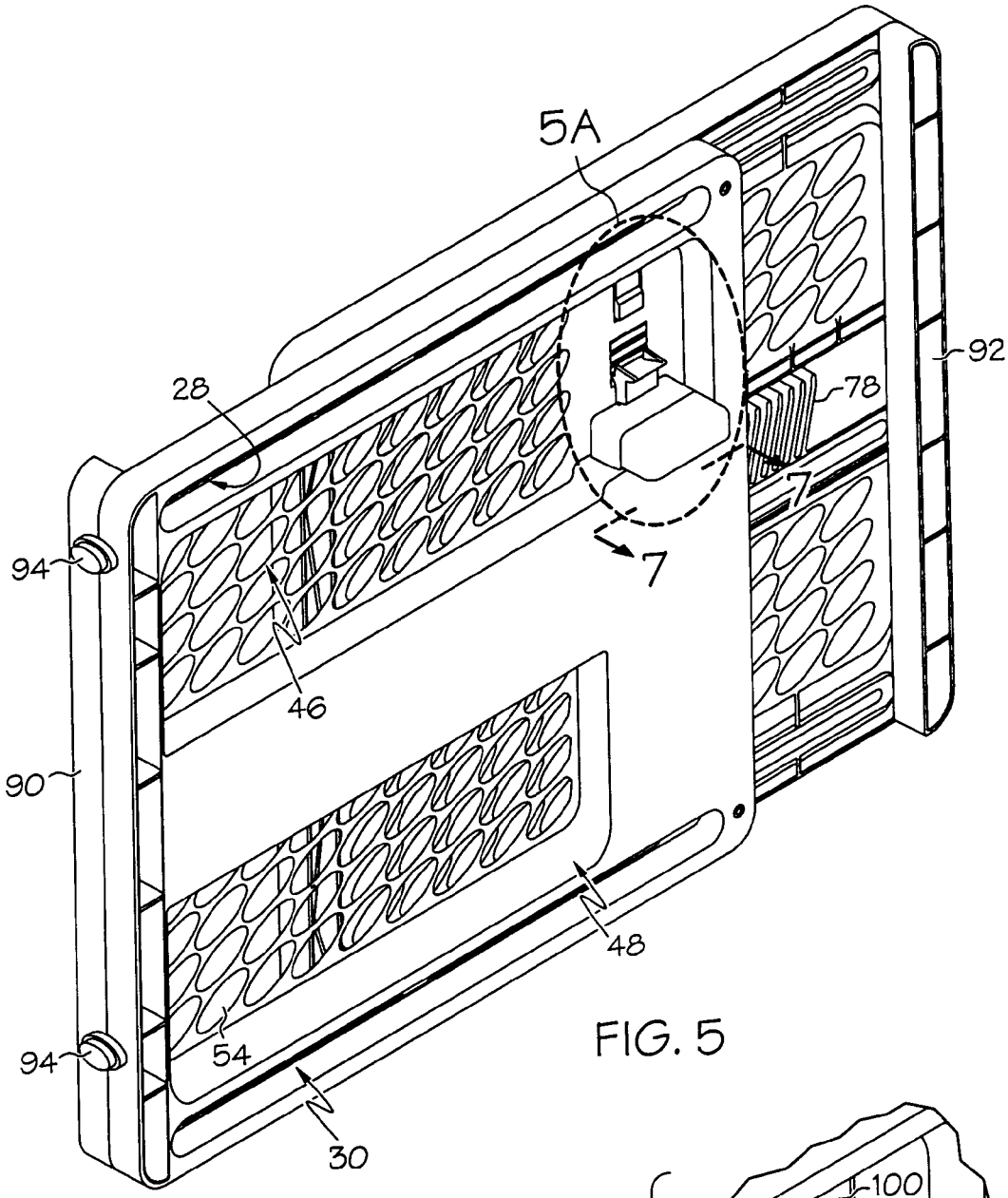
FIG. 5 is an elevated perspective view of the first exemplary embodiment of FIG. 1.
Figure 5A:
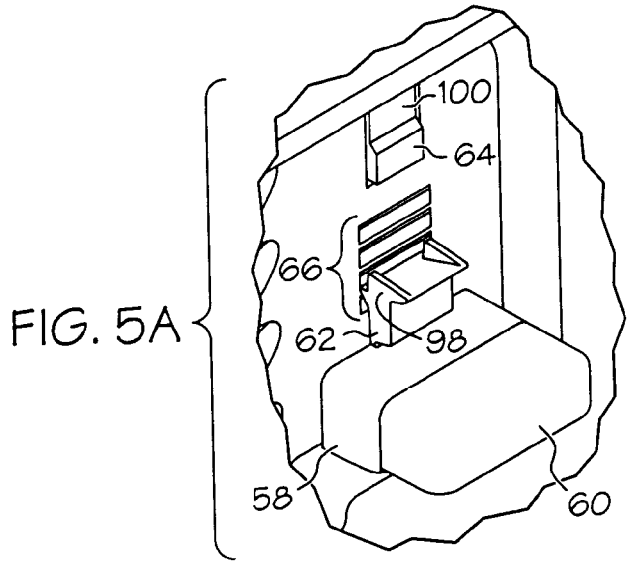
FIG. 5A is a magnified view of the interaction between the catch and rectangular holes shown in FIG. 5.
Figure 7:
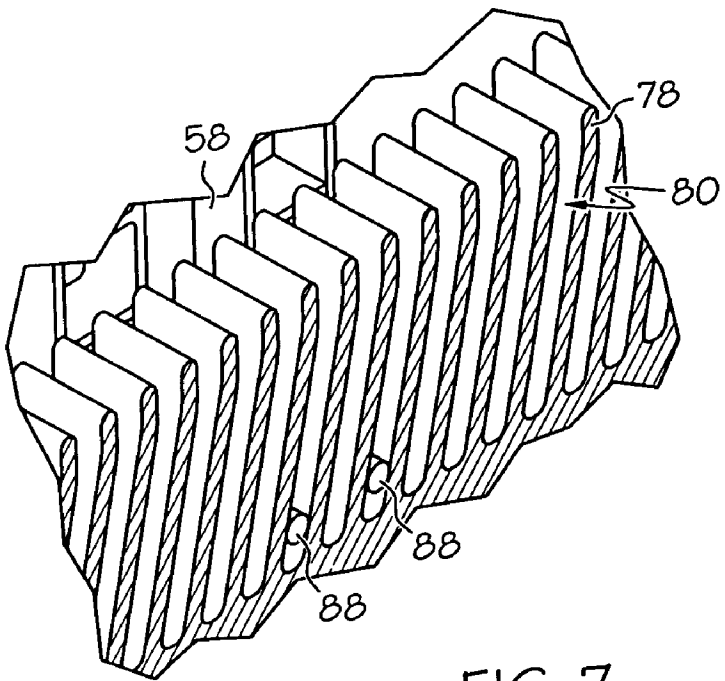
FIG. 7 is an isolated view showing the interaction between the projections of the handle and the ribs at a second position of the exemplary embodiments of the present invention.
Figure 6:
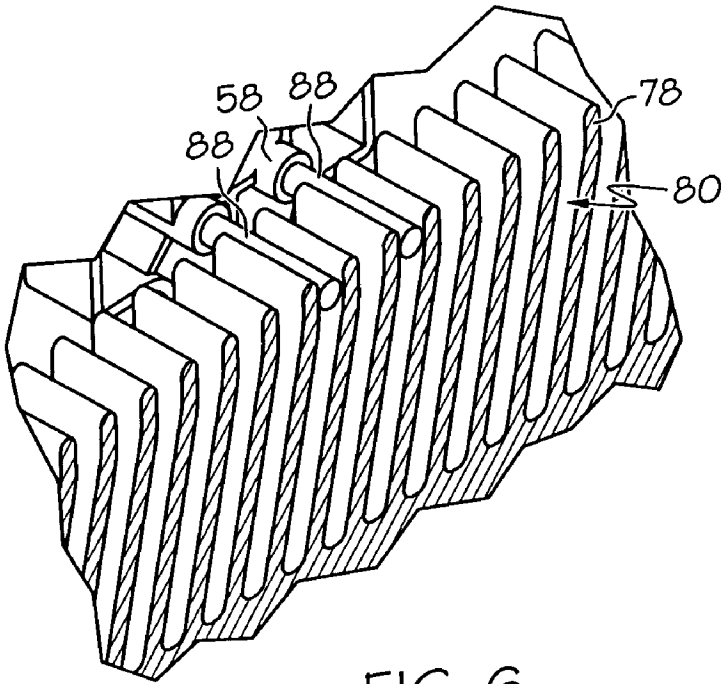
FIG. 6 is an isolated view showing the interaction between the projections of the handle and the ribs at a first position of the exemplary embodiments of the present invention.

Referencing FIGS. 5-7, the handle 58 may also be repositioned to mount the catch 98 within one of the holes 66. This repositioning of the handle 58 causes the projections 88 to travel along the ribs 78 and transform the vertical movement of the handle 58 into incremental horizontal movement of the sections 12, 14 with respect to one another (compare FIGS. 6 and 7). The incremental horizontal movement of the sections effectively changes the width of the gate to either wedge the sections 12, 14 within the boundary of the opening, preferable with the bumpers 94 contacting the boundary, or dislodge the gate from the boundary.

The present invention is particularly advantageous where boundary dimensions are common. For example, in a residential dwelling, doorframe dimensions are typically uniform throughout. The present invention includes a memory feature that allows the incremental decrease in the widthwise dimension of the gate 10 to facilitate removal of the gate 10 from an opening, but enables the gate 10 to substantially conform to the opening or like dimensioned openings by simply repositioning the handle 58 to provide an incremental increase in width.

Figure 8:
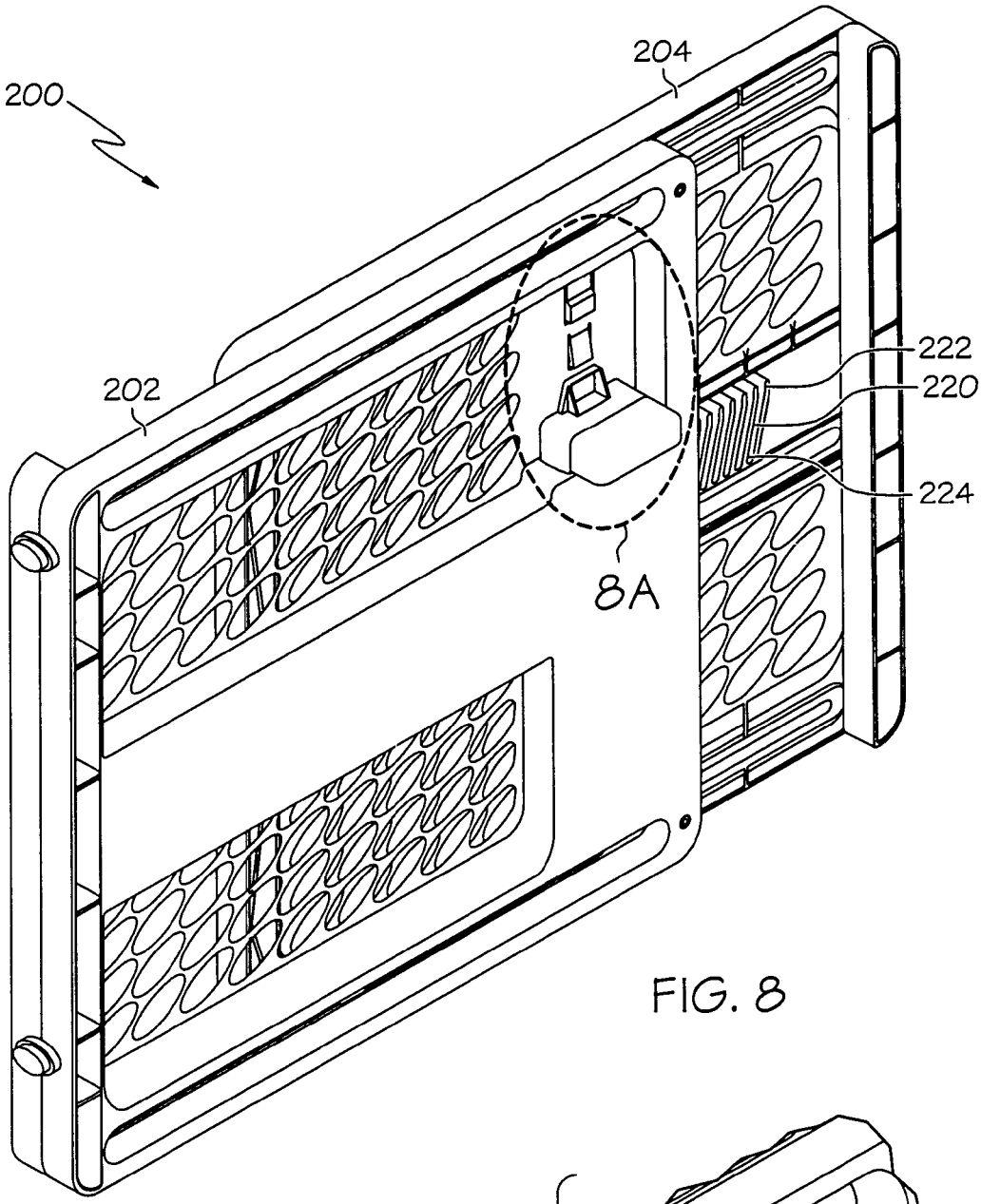
FIG. 8 is a frontal perspective view of a second exemplary embodiment in accordance with the present invention.
Figure 8A:
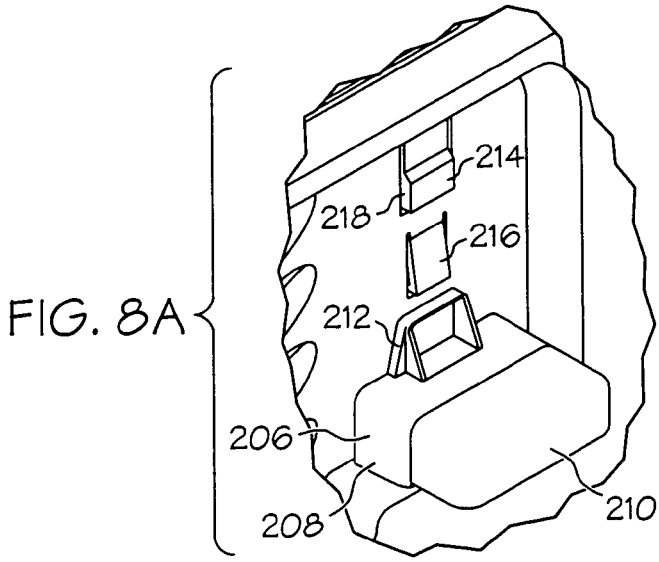
FIG. 8A is a magnified view of the interaction between the loop and detents shown in FIG. 8.

Referencing FIG. 8, a second exemplary embodiment 200 of the invention includes a first gate section 202 slidably mounted to a second gate section 204. The first gate section 202 includes a handle 206 that is repositionable through a slot 208 formed in the first gate section. The handle 206 includes a finger gripping aspect 210 and a loop 212 adapted to interface with two biased detents 214, 216. The first detent 214 includes a block projection 218 adapted to be secured within the loop 212 that corresponds with free movement between the gate sections 202, 204 to accommodate expansion or contraction of the gate 200 anywhere between its fully contracted position and its fully extended position. Depressing of the block 218 to overcome the bias of the first detent 214 enables the loop 212 to pass thereby. The biased nature of the detent 214 pushes the block 218 into the line of travel of the loop 212 such that once the loop 212 passes the block 218, upward movement of the handle 206 is inhibited beyond the position where the top of the loop 212 contacts the bottom of the block 218. Repositioning the loop 212 below the block 218 corresponds with the positioning of a pin (not shown), coupled to the handle 206, within a channel 220 formed by consecutive rods 222 associated with the second gate section 204.

The rods 222 are angled to convert the vertical movement of the handle 206 into horizontal movement of at least one of the gate sections 202, 204. The angle of the rods 222 determines in part how the conversion of vertical movement by the handle 206 is converted to horizontal movement of at least one of the sections 202, 204. Movement of the pin along the rod 222 causes an incremental change in the widthwise dimension of the gate 200. As the loop 212 passes beyond the second detent 216, the biased nature of the second detent 216 is directed into the line of travel of the loop 212 to inhibit upward movement of the handle 206 beyond the point at which the top of the loop 212 contacts the bottom of the second detent 216. This movement of the handle 206 to a position where the loop 212 is beneath the second detent 216 effectively locks the widthwise dimension of the gate. In a further detailed exemplary embodiment, the loop 212 being positioned underneath the second detent 216 corresponds to the pin being positioned at the base 224 of the channel 220.

To decrease the width of the gate 200, the second detent 216 is pushed out of the line of travel of the loop 212 to enable the loop 212 to pass thereby. This movement also corresponds with movement of the pin within the channel 220 to incrementally decrease the width of the gate 200. To further decrease the width of the gate 200, the block 218 of the second detent 214 is pushed out of the line of travel of the loop 212 to enable the top of the loop 212 to pass thereby, which corresponds to the pins being removed from the channels 220.

An exemplary procedure for using the second exemplary embodiment 200 to inhibit movement through a doorway, for example, may include positioning the block 218 within the loop 212 of the handle 206. Thereafter, the gate sections 202, 204 are repositioned with respect to one another to approximate the boundary of the doorway. The block 218 may be depressed to allow travel of the handle 206 that seats the pin within one of the channels 220. Concurrently therewith or following movement of the loop 212 beyond the block 218, the handle 206 may be repositioned such that the loop 212 passes beyond the second detent 216 to effectively drive the pin lower within a channel 220 and wedge the gate 200 within the door opening. The opposite procedure may be followed to contract the gate 200 from its extended position to facilitate removal or repositioning of the gate 200.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the invention as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly recited in the claims. Likewise, it is to be understood that it is not necessary to meet any or all of the identified advantages or objects of the invention disclosed herein in order to fall within the scope of any claim, since the invention is defined by the claims and since inherent and/or unforeseen advantages of the present invention may exist even though they may not have been explicitly discussed herein.

What is claimed is:

1. A variable width gate for spanning an opening comprising:

a first gate section mounted to a second gate section, wherein one of the first gate section and the second gate section includes a plurality of sequentially spaced apart ribs, with each of the ribs including an oblique segment that is adjacent to the oblique segment of an adjacent one of the ribs, the oblique segments each having a length;

a tracker operatively coupled to the other one of the first gate section and the second gate section, the tracker selectively slidably engagable with the oblique segment of at least one of the ribs to convert interaction between the tracker and the at least one rib into widthwise movement of the first gate section with respect to the second gate section; and a lock mounted to the first gate section to substantially secure the first gate section in relation to the second gate section, the lock comprising a handle operatively coupled to one of the tracker and the at least one rib so that displacement of the handle relative to the first gate section manipulates a position of the tracker in relation to the at least one rib in order to cause the interaction between the tracker and the at least one rib and the widthwise movement of the first gate section with respect to the second gate section, the handle being movable between a first position, a second position, and a plurality of third positions;

wherein the handle operatively engages locking features of the first gate section to releasably secure the handle with respect to the first gate section in the first position and the plurality of third positions;

wherein, in the first position, the handle allows the widthwise movement of the first gate section with respect to the second gate section within a first predetermined range by maintaining the tracker disengaged from the plurality of sequentially spaced apart ribs;

wherein, in the second position, the handle allows the widthwise movement of the first gate section with respect to the second gate section within a second predetermined range, the second predetermined range being less than the first predetermined range and corresponding substantially to lateral spaces between the tracker and an adjacent pair of the plurality of spaced apart ribs;

wherein, in the plurality of third positions, the handle causes the tracker to engage the oblique segment of the at least one rib; and wherein each of the plurality of third positions corresponds to a different point of engagement of the tracker with the oblique segment of the at least one rib such that moving the handle from a first of the third positions to a last of the third positions moves the tracker a distance substantially corresponding to the length of the oblique segment of the at least one rib.

2. The variable width gate of claim 1, wherein the first gate section is slidably mounted to the second gate section.

3. The variable width gate of claim 1, wherein the locking features include a detent to releasably secure the handle in the first position.

4. The variable width gate of claim 3, wherein the handle is disengaged from the detent to allow the handle to move from the first position to the second position.

5. The variable width gate of claim 1, wherein the first gate section and the second gate section collaborate to form a shield substantially isolating the at least one rib and the tracker from a user.

6. The variable width gate of claim 1, wherein:

the second gate section includes the tracker; and the first gate section includes the at least one rib, wherein the at least one rib is operatively engageable with the tracker.

7. The variable width gate of claim 1, wherein:

the second gate section includes the at least one rib;

the first gate section includes the tracker, wherein the tracker is operatively engageable with the at least one rib.

8. The variable width gate of claim 1, wherein:

the first gate section is slidably mounted to the second gate section;

the first gate section includes a first stop limiting the second gate section from sliding beyond the first stop;

the second gate section includes a second stop limiting the first gate section from sliding beyond the second stop; and an overall widthwise dimension of the gate is minimized when the first gate section approximates the second stop and the second gate section approximates the first stop.

9. A repositionable device to forestall movement through an opening, the device comprising:

a variable width gate having an extender for expanding the variable width gate along a widthwise dimension thereof, the extender including a plurality of fingers and a mating boss, at least one of the fingers engagable by the mating boss;

a repositionable handle movably mounted to the variable width gate, the handle operatively coupled to the extender to actuate the extender through movement of the handle relative to the gate, the handle being movable relative to the gate between a first position, a second position, and a plurality of third positions, the handle operatively engaging locking features of the variable width gate to lock the handle with respect to the variable width gate in one of the first position and the plurality of third positions; and an engagement between the at least one finger and the mating boss being operative to transform sliding motion between the at least one finger and the mating boss, in a first axial direction, into an expanding motion of the gate along a second axial direction to change the widthwise dimension of the variable width gate, wherein the first axial direction is perpendicular to the second axial direction;

wherein the first position of the handle allows the widthwise dimension of the gate to be varied within a first predetermined range by maintaining the boss disengaged from the plurality of fingers, the second position of the handle allows the widthwise dimension of the gate to be varied within a second predetermined range by retaining the boss between an adjacent pair of the plurality of fingers, and each of the plurality of third positions of the handle inhibits variance in the widthwise dimension of the gate through engagement of the boss with the adjacent pair of the plurality of fingers, wherein the at least one finger comprises one of the adjacent pair of fingers and each of the plurality of third positions of the handle corresponds to a different point of engagement of the boss with the at least one finger such that moving the handle from a first of the third positions to a last of the third positions changes the widthwise dimension of the variable width gate, where the second predetermined range is less than the first predetermined range.

10. The repositionable device of claim 9, wherein one of the locking features comprises a catch operative to lock the handle with respect to the gate and lock the engagement between the at least one finger and the mating boss to fix the widthwise dimension of the variable width gate.

11. The repositionable device of claim 10, wherein the handle may be released from the catch to allow the sliding motion between the at least one finger and the mating boss for manipulating the widthwise dimension of the variable width gate within the opening between a first position in which the variable width gate is wedged in the opening and a second position in which the variable width gate substantially spans the opening.

12. The repositionable device of claim 9, wherein:

the variable width gate includes a first gate section slidably mounted to a second gate section;

the first gate section includes a first stop limiting the second gate section from sliding beyond the first stop;

the second gate section includes a second stop limiting the first gate section from sliding beyond the second stop; and the widthwise dimension of the variable width gate is minimized when the first gate section engages the second stop and the second gate section engages the first stop.

13. The repositionable device of claim 9, wherein:

the variable width gate includes at least one notch between the adjacent pair of the plurality of fingers;

the mating boss is adapted to be received within the at least one notch; and the mating boss is operatively coupled to the handle.

14. The repositionable device of claim 9, wherein:

the mating boss comprises a plurality of mating bosses;

the at least one finger is adapted to be engaged by at least one of the plurality of mating bosses; and the at least one finger is operatively coupled to the handle.

15. The repositionable device of claim 9, wherein the at least one finger is oriented obliquely with respect to a horizontal plane.

16. The repositionable device of claim 9, wherein the gate comprises a first panel including the mating boss; and a second panel including the handle operatively coupled to the at least one finger;

wherein the first panel and the second panel are slidably mounted to one another.

17. The repositionable device of claim 9, wherein the gate comprises a first panel including the plurality of fingers; and a second panel including the handle operatively coupled to the mating boss;

wherein the first panel and the second panel are slidably mounted to one another.

18. The repositionable device of claim 9, wherein the locking features comprise a plurality of holes in the variable width gate for locking the handle in the plurality of third positions.

19. The repositionable device of claim 9, wherein the gate comprises a first panel including the handle operatively coupled to a plurality of mating bosses; and a second panel including the plurality of fingers;

wherein the first panel and the second panel are slidably mounted to one another.

20. The repositionable device of claim 10, wherein another one of the locking features comprises a second catch operative to maintain the handle in the first position and maintain the mating boss disengaged from the plurality of fingers allowing a user to vary the widthwise dimension of the variable width gate.

21. The repositionable device of claim 9, wherein the gate comprises a first panel including the handle operatively coupled to the plurality of fingers; and a second panel including the mating boss;

wherein the first panel and the second panel are slidably mounted to one another.

* * * * *